United States Patent [19]

Kassai

[11] Patent Number: 4,700,831

[45] Date of Patent: Oct. 20, 1987

[54] COMPARTMENTED PACKAGING BOX FOR COMMODITY AND ACCESSORY

[75] Inventor: Kenzou Kassai, Osaka, Japan

[73] Assignee: Aprica Kassai Kabushikikaisha, Osaka, Japan

[21] Appl. No.: 827,354

[22] Filed: Feb. 7, 1986

[30] Foreign Application Priority Data

Mar. 25, 1985 [JP] Japan ..... 60-60428

[51] Int. Cl.[4] ..... B65D 5/46; B65D 5/52

[52] U.S. Cl. ..... 206/232; D9/346; 206/45.13; 206/424; 229/52 B; 229/162

[58] Field of Search ..... 40/312, 313; 206/45.13, 206/45.28, 45.29, 45.3, 232, 424, 459, 472; D9/341, 346, 457; 229/15, 27, 52 B, 118, 121, 122, 149, 151, 155, 195, 162

[56] References Cited

U.S. PATENT DOCUMENTS

| | | | |
|---|---|---|---|
| 1,094,326 | 4/1914 | Ham | 206/45.13 |
| 1,787,569 | 1/1931 | Deutschmeister | 206/232 |
| 2,479,472 | 8/1949 | Coplon | 206/232 |
| 2,799,391 | 7/1957 | Eisner | 206/232 |
| 3,278,015 | 10/1966 | Bernstein | 206/461 |
| 3,641,684 | 2/1972 | Paige | 206/232 |
| 4,255,872 | 3/1981 | Williams, Sr. | 206/232 |
| 4,314,635 | 2/1982 | Fraser et al. | 206/232 |
| 4,566,590 | 1/1986 | Manning et al. | 206/232 |

FOREIGN PATENT DOCUMENTS

| | | | |
|---|---|---|---|
| 1258382 | 3/1961 | France | 229/27 |
| 0771788 | 4/1957 | United Kingdom | 206/232 |
| 2006713 | 5/1979 | United Kingdom | 206/459 |

*Primary Examiner*—Jimmy G. Foster

*Attorney, Agent, or Firm*—W. G. Fasse; D. H. Kane, Jr.

[57] ABSTRACT

One of the outer lateral walls of a box body is provided along its side or edge with a door (member) hinged to the box body, whereby a bag is formed between the door member and the one outer lateral wall of the box body. A commodity such as a knockdown toy is stored in the box while a book or booklet including information on childcare and information on how to use the toy is inserted into the bag.

14 Claims, 4 Drawing Figures

COMPARTMENTED PACKAGING BOX FOR COMMODITY AND ACCESSORY

BACKGROUND OF THE INVENTION

This invention relates to a packaging box and particularly to a packaging box having a accessorial portion on its outer side.

Conventionally, in keeping or transporting commodities, it has been common practice to store these commodities in packaging boxes. In some cases, such packaging boxes are made, in part or entirely, of a transparent material to enable commodities to be displayed in a shop while they are stored in the packaging boxes.

Many commodities on the market are accompanied by instruction manuals. An instruction manual is usually stored in a packaging box together with a commodity. In most cases, the purchaser looks through the instruction manual before using the commodity. Thereafter, however, he rarely pays attention to such instruction manual and, in some cases, he loses or even discards it. Thus, when the need for the instruction manual arises again, he will feel much inconvenienced.

On the part of the supplier of the commodity, there is a desire for the user to keep the instruction manual, in the form of a booklet or a book, for ever in safety. For example, if a toy or the like useful for childcare is the commodity, the supplier of such commodity would add to the commodity a booklet or a book which not only describes the way of using the toy but also serves the purpose of a book on childcare. In such a case, it is very undesirable to the supplier that such booklet or book is thrown away through carelessness.

SUMMARY OF THE INVENTION

As described above, it is desired that a book the content of which is not only limited to information to be provided by an instruction manual, be used together with the commodity for a long time by the consumer.

Accordingly, an object of the invention is to provide a packaging box having a construction which serves as a package for a commodity and which also helps the consumer to take care not to throw away an accessory such as a book.

This invention is a packaging box characterized in that a bag-like portion having an opening in its top is added to an outer lateral surface of the packaging box such as a prismatic box. Thus, the bag-like portion serves as a container for storing an accessory such as a book.

According to this invention, since the bag-like portion is installed on the packaging box for performing the particular function of storing an accessory such as a book, the consumer will pay attention to the bag-like portion. Therefore, there is some incentive for the consumer to keep the accessory rather than throwing it away. The reason is that there is a tendency for consumers to throw away things if there is no place for storing them. Further, since the consumer can use the box body as a filing cabinet and the bag-like portion as a bookstand, the packaging box itself of this invention will be utilized without being thrown away.

A consumer may sometimes desire to keep an accessory such as a book rather than throwing it away. In such case, according to the packaging box of this invention, the consumer's desire can simply be met by making use of the bag-like portion. Further, since the consumer can use the box body as a filing cabinet and the bag-like portion as a bookstand, the packaging box itself of this invention will have a more permanent usefulness and hence be utilized without being thrown away.

Further, since the bag-like portion is attached to the outer side of the box body, if the accessory such as a book is inserted therein, such accessory can be held in close contact with the box body. Therefore, commodities can be displayed in a shop while they are stored in the packaging boxes without becoming bulky.

There is a tendency that consumers prefer packaging boxes over the content if the packaging boxes are particularly attractive. Therefore, it is even said that it is the design of a packaging box that may determine the sale of a commodity. When considered under these circumstances, it may be said that a box having a bag-like portion adapted to store an accessory such as a book is attractive to the eye and suits consumer's taste.

These object and other objects, features, aspects and advantages of the present invention will become more apparent from the following detailed description of the present invention when taken in conjunction with the accompanying drawings.

DESCRIPTION OF THE PREFERRED EMBODIMENTS AND OF THE BEST MODE OF THE INVENTION

Figure 1:
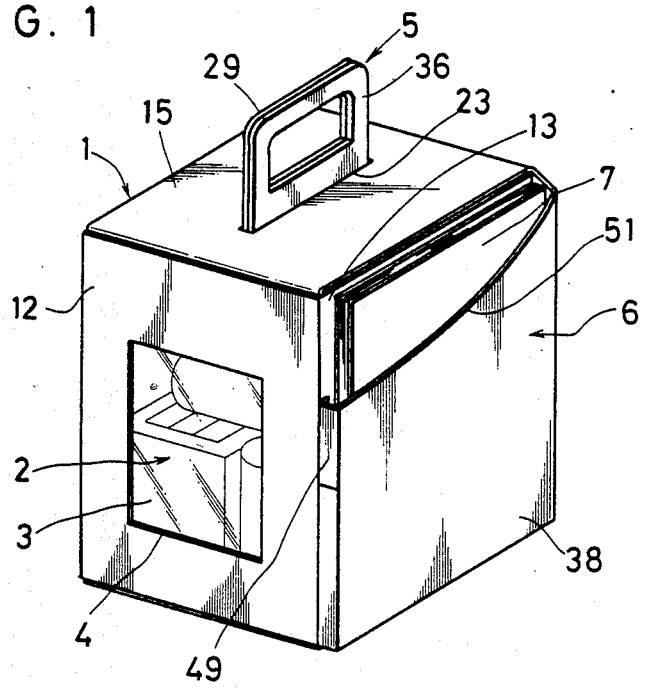
FIG. 1 is a perspective view showing the external appearance and construction of an embodiment of the invention.
Figure 2:
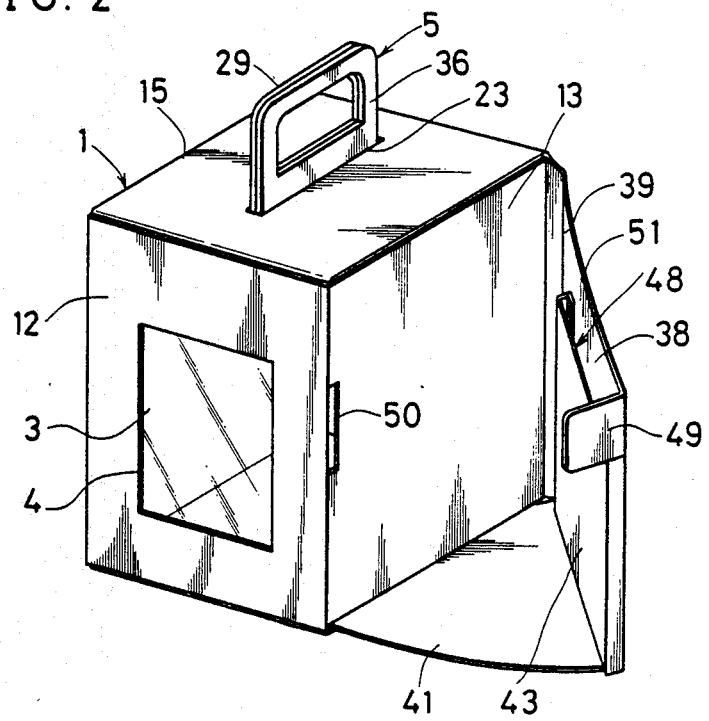
FIG. 2 is a perspective view showing the opened state of the door-type bag portion 38 of the packaging box of FIG. 1 with a pocket on the inwardly facing side of the door-type bag portion.
Figure 3:
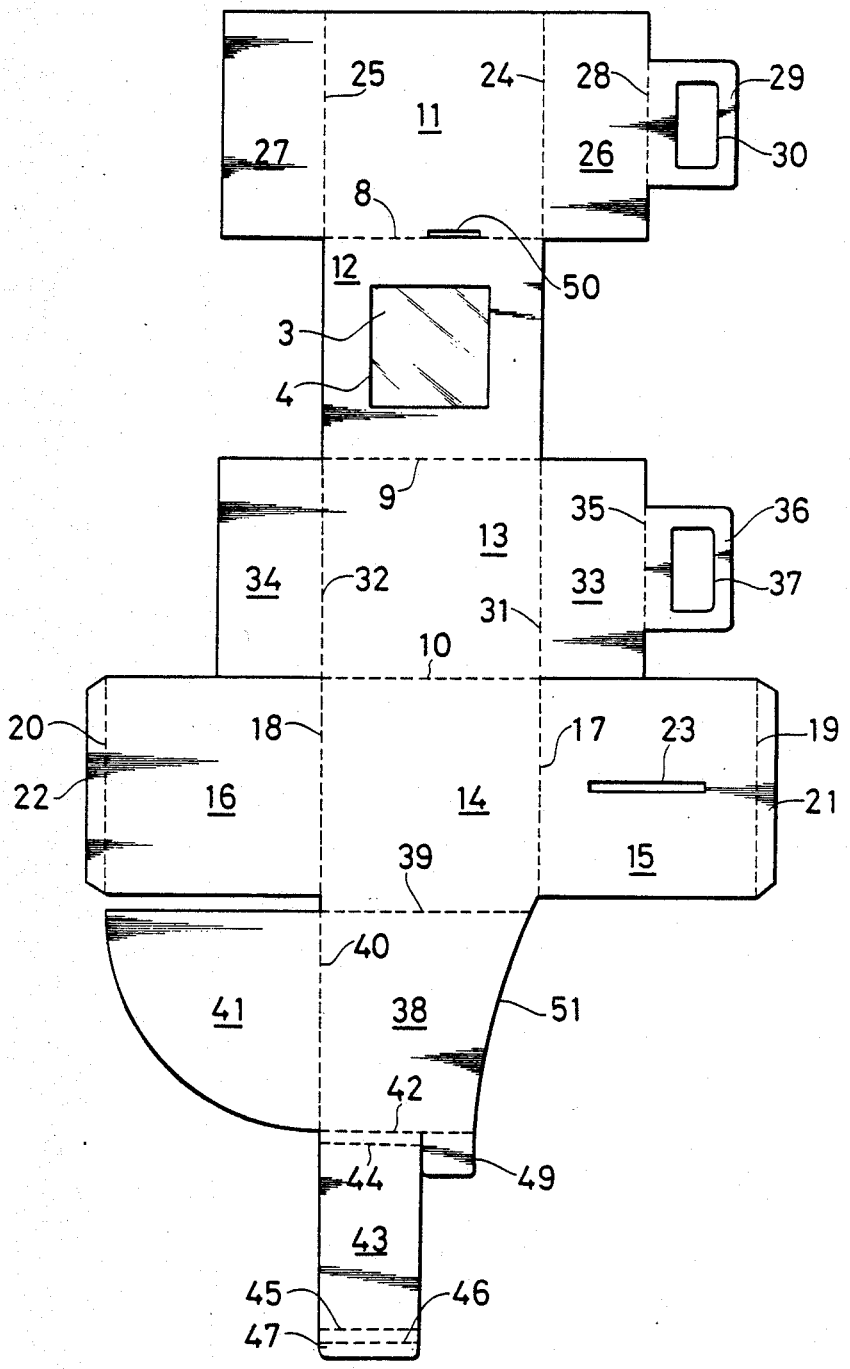
FIG. 3 is a developed view of a blank for forming the packaging box shown in FIGS. 1 and 2.

FIG. 1 is a perspective view of the construction and external appearance of a packaging box 1 of the invention with commodity 2 inside the box which is deformable to a state shown in FIG. 2, and which can be assembled from a foldable blank shown in a developed view in FIG. 3.

The commodity 2 can be seen through a window 4 having a transparent sheet 3 applied thereto. Further, there is a handle 5 projecting from the surface of the upper wall or lid 15 of the box body 1.

One lateral wall of the box 1 has added thereto a door-type bag 6 having an opening in its top. Inserted in the door-type bag portion 6 is a book 7 which contains information on childcare in addition to information to be provided by an instruction manual for the commodity 2, e.g., a knockdown toy. Preferably, the box is also provided with a pocket 48 or 52 to be described below.

Referring to FIGS. 1 to 3, the method of assembling the packaging box 1 will now be described. This assembling method can be understood by describing the developed view shown in FIG. 3 with reference to the perspective views shown in FIGS. 1 and 2. The box 1 is for example, a rectangular prism, or a quadrangular prism formed by four lateral surfaces in the form of first, second, third, and fourth walls, 11, 12, 13, and 14 successively interconnected by three folds 8, 9 and 10, as shown in FIG. 3. In FIGS. 1 and 2, only the second and third lateral walls 12 and 13 appear. The window 4 is formed in the second lateral wall 12.

Upper and lower lids 15 and 16 form the upper and lower end surfaces of the rectangular prism. The lids 15, 16 are connected to the fourth lateral wall 14 by folds 17 and 18, respectively. Insert flaps 21 and 22 are connected to the upper and lower lids 15 and 16 by folds 19 and 20, respectively. These insert flaps 21 and 22 are positioned along the inner side of the second lateral wall 12 when the box 1 is assembled as shown in FIGS. 1 and 2. The upper lid 15 has a slot 23 for receiving the handle 5. Auxiliary wings 26 and 27 are connected to the first lateral wall 11 by folds 24 and 25, respectively. A handle flap 29 forming a portion of the handle 5 is connected to the auxiliary wing 26 by a fold 28. The handle flap 29 is formed with an opening 30 for receiving a hand.

As in the case of the first lateral wall 11, the third lateral wall 13 has auxiliary wings 33 and 34 connected by folds 31 and 32, respectively. A handle flap 36 is connected to the auxiliary wing 33 by a fold 35. The handle flap 36 has an opening 37.

When the box body 1 is assembled as shown in FIGS. 1 and 2, the auxiliary wings 26 and 33 are positioned under the upper lid 15 and in this state the two handle flaps 29 and 36 project out through the slot 36. The two handle flaps 29 and 36 are put together to form the handle 5.

Further, when the box body 1 is assembled as shown in FIGS. 1 and 2, the auxiliary wings 27 and 34 extend along the upper surface of the lower lid 16.

As is clear from a comparison between FIGS. 1 and 2, the door-type bag portion 6 is defined by a door-like portion 38, the third lateral wall 13 and a bottom portion 41. The door-like portion 38, as shown in FIG. 3, is formed by material integrally extending from the forth lateral wall 14 and hinged to the wall 14 by a fold 39. In addition, the forth lateral wall 14 has a greater width dimension than the second lateral wall 12 opposed thereto. This greater width dimension forms a spacing between the door-like portion 38 and the box body to enclose the bag portion 6 between the box body and the door-like portion 38. As a result, the fold 39 serving as a hinge for opening and closing the door-like portion 38, is positioned at a predetermined distance from the body of the box 1, as is clear from FIG. 2. The purpose of this positioning is to provide a predetermined thickness in the inner space of the bag portion 6.

A fold 40 formed along the lower side of the door-like portion 38 hinges an extension bottom portion 41, which forms for example a 90° sector, to the door-like portion 38. The extension bottom portion 41, as best shown in FIG. 2, while forming part of the bottom wall of the bag-like portion 6, is inserted between the lower lid 16 and the auxiliary wings 27, 34. Since the extension bottom portion 41 is formed as a sector as mentioned above, it does not interfere with the opening and closing of the door-like portion 38 which is made possible by the hinging fold 39.

A pocket wall 43 is connected to the door-like portion 38 by a fold 42. The pocket wall 43 is provided with folds 44, 45 and 46, the portion outside the fold 46 serving as a paste-up margin 47. As shown in FIG. 2, the pocket wall 43 is folded along the aforesaid folds 42, 44, 45 and 46 and at the paste-up margin 47 it is bonded to the inner surface of the door-like portion 38, whereby a pocket 48 is formed. Therefore, the book 7 is received in this pocket 48, although not shown in FIG. 1, when it is inserted in the bag-like portion 6.

An insert flap 49 is connected to the door-like portion 38 through said fold 42. Corresponding to this insert flap 49, a slot 50 is formed in the first lateral wall 11 along the fold 8. When the insert flap 49 is received in the slot 50 as shown in FIG. 1, the closed state of the door-like portion 38 is maintained. An upper edge 51 of the door-like portion 38 is so tailored that it is positioned below the height of the lateral surfaces of the box 1 for showing a portion of the book 7 so that it may be observed from the outside. Usually, the book 7 has its title printed in the upper region of the cover. Therefore, even if inserted in the bag-like portion 6, the title of the book 7 can be ascertained from the outside.

To take out the commodity 2 stored in the box 1, the upper lid 15 has to be opened as in the prior art. Further, to close the upper lid 15 after the commodity 2 has been stored in the box body 1, the insert flat 21 has only to be inserted along the inner side of the second lateral wall 12 with the handle flaps 29 and 36 received in the slot 23.

As shown in FIG. 2, with the door-like portion 38 half opened, the book 7 may be inserted in the pocket 48 for display in a shop. This manner of display makes the book 7 sufficiently noticeable to arouse the interest of customers; thus, the packaging box is very effective in promoting the sale of commodities.

Figure 4:
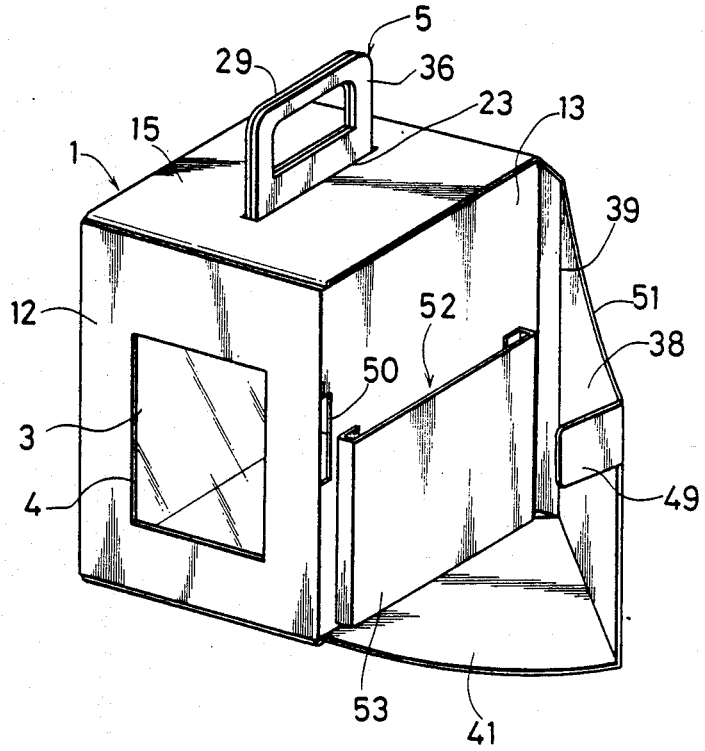
FIG. 4 is a perspective view of a packaging box according to another embodiment of the invention, showing the opened state of a door-type bag portion with a pocket on the box wall facing the door-type bag portion.

FIG. 4 is a perspective view showing another embodiment of the invention. As in FIG. 2, door-like portion 38 is shown opened. In addition, since the packaging box shown in FIG. 4 has many points in common with that described with reference to FIGS. 1 to 3, such common portions are marked with the same reference numerals to avoid repetition of the same description.

The packaging box shown in FIG. 4 is characterized in that whereas in the preceding embodiment the pocket 48 has been provided on the inner surface of the door-like portion 38 opposed to the third lateral wall 13, a pocket 52 is formed on the third lateral wall 13. The rest of the arrangement is the same as in the preceding embodiment.

The pocket 52 is formed by suitably folding a separately prepared blank 53 and bonding it to the third lateral wall 13. This pocket 52 may be provided with a bottom wall (not shown). However, even if such bottom surface wall is not provided, the extension bottom portion 41 serves its function.

Besides the two embodiments described above, other embodiments may be contemplated. These will now be described with occasional reference to the drawings.

First, a packaging box having no door-like portion 38 may be provided. For example, to describe with the help of FIG. 4, there may be an embodiment in which in FIG. 4 the pocket 52 forms a receptacle, without the door-like portion 38 and without the extension bottom portion 41.

Further, the bag-like portion 6 may be formed without providing any pocket 48 or 52. For example, even if the pocket 48 in FIG. 2 or the pocket 52 in FIG. 4 is not present, when the door-like portion 38 is closed, there will be formed a receptacle between the door-like portion 38 and the third lateral wall 13 to store the book 7.

If the pocket 48 or pocket 52 is formed with a bottom surface wall, the book 7 can be held even if there is no extension bottom portion 41.

The door-like portion 38 has been described as being formed integrally with the blank which forms the box 1, but a separate blank may be used and may, e.g., be bonded to the box 1.

The developed view shown in FIG. 3 is just one example, and, as is known, a packaging box of substantially the same configuration could be formed of a blank of another shape.

A packaging box is generally made of cardboard, but is may be made of another material, such as plastic sheet. Rather than using a transparent sheet in the window alone, other portions of the box may be made of transparent material or such transparent portions may be dispensed with.

The above embodiments refer to a combination of a commodity 2, such as a knockdown toy, and a book 7 serving both as a book on childcare and as an instruction manual, but the invention is not limited to such combination. For example, there may be a combination such that colored paper, a pair of scissors and paste are stored in the box body while a book serving as a guidebook for the art of folding paper into various figures is stored in the bag-like portion. There may be a combination of a commodity not intended for children and a book. Further, the accessory to be combined with commodity need not be a book.

The shape of the body of the packaging box according to the invention is not limited to a rectangular prism; it may have a shape other than a prism, for example, a triangular or hexagonal prism.

Although the present invention has been described and illustrated in detail, it is clearly understood that the same is by way of illustration and example only and is not to be taken by way of limitation, the scope of the present invention being limited only by the terms of the appended claims.

What is claimed is:

1. A packing box, comprising a plurality of outer lateral wall members, an upper end wall member and a lower end wall member together forming a prismatic box body, said packaging box further including door-type wall means forming a bag portion having an opening in its top, connecting means operatively hinging said door-type wall means to one of said outer lateral wall members of said box body for enclosing said bag portion between said door-type wall means and said box body, said door-type wall means including an extension bottom member connected to a lower edge of said door-type wall means, said extension bottom member extending approximately in a plane in which said lower end wall member of said box body extends, and means for inserting said extension bottom member into said box body for substantially positioning said extension bottom member on said lower end wall member and for closing said bag portion at its bottom.

2. The packaging box of claim 1, further comprising pocket means (48) formed on a surface of said door-type wall means facing said box body.

3. The packaging box of claim 2, wherein said pocket (48) is formed of a material integrally extending from said door-type wall means.

4. The packaging box of claim 1, further comprising a pocket means (52) formed on a surface of said box body facing said door-type wall means.

5. The packaging box of claim 1, wherein said door-type wall means has an upper edge positioned lower than a height of said box body.

6. The packaging box of claim 1, further comprising an insertion flap (49) formed on a free end edge of said door-type wall means, one of said outer lateral wall members facing said door-type wall means having a fitting slot for said insertion flap for maintaining a closed state of said bag portion when said insertion flap is received in said fitting slot.

7. The packaging box of claim 1, wherein said box body is a rectangular prism.

8. A packaging box comprising a prismatic box body including a plurality of outer lateral wall members including a first lateral wall member (11) with a fitting slot (50) and a second lateral wall member (14) with a width dimension larger than a given width dimension of any other of said plurality of outer lateral wall members, an upper end wall member and a lower end wall member, further door-type wall means forming a bag portion having an opening in its top, hinging means operatively connecting said further door-type wall means to said second outer lateral wall member having said larger width dimension, said larger width dimension providing a spacing between said box body and said further door-type wall means, said spacing providing said bag portion enclosed between said further door-type wall means and said first outer lateral wall member (11) having said fitting slot, said packaging box further comprising a flap (49) formed on a free end edge of said further door-type wall means for insertion into said fitting slot to maintain a closed state of said further door-type wall means when said insertion flap is received in said fitting slot, said insertion flap having a length sufficient for bridging said spacing and for said insertion.

9. The packing box of claim 8, wherein said box body is a rectangular prism.

10. The packaging box of claim 8, further comprising pocket means (48) formed on an inner surface of said further door-type wall means, said pocket means facing said first outer lateral wall member of said box body.

11. The packaging box of claim 10, wherein said pocket means (48) is formed of a material integrally extending from said further door-type wall means.

12. The packaging box of claim 8, further comprising a pocket means (52) attached to a surface of said first outer lateral wall member facing said further door-type wall means.

13. The packing box of claim 8, wherein said further door-type wall means has an upper edge positioned lower than the height of said box body.

14. The packaging box of claim 8, wherein said further door-type wall means includes an extension bottom member connected to a lower edge of said further door-type wall means, said extension bottom member extending approximately in a plane in which said lower end wall member of said box body extends, and means for inserting said extension bottom member into said box body for substantially positioning said extension bottom member on said lower end wall member and for closing a bottom of said bag portion.

* * * * *